US008730132B2

(12) United States Patent
Choi et al.

(10) Patent No.: US 8,730,132 B2
(45) Date of Patent: May 20, 2014

(54) ORGANIC LIGHT EMITTING DISPLAY DEVICE AND METHOD OF OPERATING THE SAME

(75) Inventors: Sang-Moo Choi, Suwon-si (KR); Yong-Sung Park, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1248 days.

(21) Appl. No.: 11/506,628

(22) Filed: Aug. 18, 2006

(65) Prior Publication Data

US 2007/0057877 A1 Mar. 15, 2007

(30) Foreign Application Priority Data

Sep. 15, 2005 (KR) ..... 10-2005-0086440

(51) Int. Cl.
*G09G 3/30* (2006.01)

(52) U.S. Cl.
USPC ..... 345/76; 345/77

(58) Field of Classification Search
USPC ..... 345/55–100, 204–215, 87–104, 345/204–215; 315/169.3
See application file for complete search history.

(56) References Cited

U.S. PATENT DOCUMENTS

| | | | | |
|---|---|---|---|---|
| 6,366,026 | B1 | 4/2002 | Saito et al. | |
| 7,375,705 | B2 * | 5/2008 | Morita | 345/76 |
| 2003/0179164 | A1 * | 9/2003 | Shin et al. | 345/76 |
| 2004/0041754 | A1 | 3/2004 | Inukai | |
| 2005/0024297 | A1 * | 2/2005 | Shin | 345/76 |
| 2005/0116918 | A1 * | 6/2005 | Shin | 345/100 |
| 2005/0140666 | A1 * | 6/2005 | Shin | 345/211 |
| 2006/0038765 | A1 * | 2/2006 | Lee et al. | 345/100 |
| 2006/0071884 | A1 * | 4/2006 | Kim | 345/76 |
| 2006/0097965 | A1 * | 5/2006 | Deane et al. | 345/76 |
| 2006/0107146 | A1 * | 5/2006 | Kim et al. | 714/727 |
| 2006/0250331 | A1 * | 11/2006 | Sempel et al. | 345/76 |

FOREIGN PATENT DOCUMENTS

| | | |
|---|---|---|
| CN | 1637793 | 7/2005 |
| CN | 1637794 A | 7/2005 |
| CN | 1658262 | 8/2005 |
| EP | 0837445 A1 | 4/1998 |
| EP | 1577869 A1 | 9/2005 |
| WO | WO 2004/066250 A1 | 8/2004 |
| WO | WO 2004/0086347 A2 | 10/2004 |
| WO | WO 2005/116968 A1 | 12/2005 |

OTHER PUBLICATIONS

Chinese Office Action issued on May 23, 2008 in corresponding Chinese Patent Application No. 200610151651.6.
European Search Report for EPP95653 on Oct. 18, 2007.
European Examination Report dated Jul. 13, 2010 for European Application No. EP 06-254-812.8 which corresponds to the captioned application.

* cited by examiner

*Primary Examiner* — Alexander Eisen
*Assistant Examiner* — Nelson Lam
(74) *Attorney, Agent, or Firm* — Knobbe, Martens, Olson & Bear LLP

(57) ABSTRACT

An organic light emitting display (OLED) device having a demultiplexer and a method of operating the OLED are disclosed. In the OLED device, each pixel column is provided two data lines, and each data line is connected to odd or even row pixels of the column. Accordingly, a data signal can be supplied to one of the data lines during one scan period, and transmitted to the corresponding pixels during a next scan period. Thus, because the data driver is only driving half the pixels of the column, the driving time is reduced.

22 Claims, 6 Drawing Sheets

ORGANIC LIGHT EMITTING DISPLAY DEVICE AND METHOD OF OPERATING THE SAME

CROSS-REFERENCE TO RELATED APPLICATIONS

This application claims priority to and the benefit of Korean Patent Application No. 2005-86440, filed Sep. 15, 2005, which is incorporated herein by reference in its entirety.

BACKGROUND OF THE INVENTION

1. Field of the Invention

The present invention relates to an organic light emitting display (OLED) device, and more particularly, to an OLED device in which demultiplexers supply data signals using double data lines in order to secure sufficient time to supply the data signals to the data lines and transmit the data signals to pixels.

2. Description of the Related Technology

Recent years have seen considerable research into flat panel displays (FPDs) because they can be made smaller and lighter than display devices using cathode ray tubes (CRTs). Among the FPDs, an organic light emitting display (OLED) device has attracted much attention as the next-generation FPD because of excellent luminance and viewing angle characteristics.

Unlike a liquid crystal display device (LCD), the OLED device needs no additional light source and makes use of a light emitting diodes that emit certain colors of light. The light emitting diode emits light with brightness corresponding to the amount of driving current that is supplied to an anode electrode.

FIG. 1 is a schematic diagram of a conventional OLED device.

The OLED device includes a pixel portion 10, a scan driver 20, a data driver 30, and an emission driver 40.

The scan driver 20 sequentially supplies scan signals to scan lines S1-Sn in response to scan control signals (i.e., a start pulse and a clock signal) output from a timing controller (not shown).

The data driver 30 supplies data voltages corresponding to red (R), green (G), and blue (B) data to data lines D1-Dm in response to data control signals output from the timing controller.

The emission driver 40 comprises shift registers and sequentially supplies emission control signals to emission control lines E1-En in response to a start pulse and a clock signal output from the timing controller.

The pixel portion 10 includes a plurality of pixels P11-Pnm, which are located in regions where a plurality of scan lines S1-Sn and a plurality of emission control lines E1-En intersect a plurality of data lines D1-Dm. The pixel portion 10 displays an image according to an applied data voltage.

Each of the pixels P11-Pnm includes R, G, and B sub-pixels.

In the pixel portion 10, the R, G, and B sub-pixels have the same circuit construction and emit R, G, and B light with brightness corresponding to current supplied to each organic light emitting diode sub-pixel. Thus, each of the pixels P11-Pnm combines light emitted from the R, G, and B sub-pixels and displays a specific color according to the combination of sub-pixel color and brightness.

Such an OLED device requires three data driving circuits to supply data signals from the data driver 30 to three (R, G, and B) data lines connected to the pixel portion 10. However, it is difficult to provide the data driving circuits in a number equal to the number of the data lines due to the area of the panel and the fabrication cost. Also, as the number of pixels of the OLED device increases, the OLED device needs more data driving circuits.

FIG. 2 is a schematic diagram of the data driver of a conventional OLED device.

Referring to FIG. 2, the conventional OLED device includes a data driver 30 having demultiplexers 32.

The data driver 30 includes an m number of demultiplexers 32 and an m number of data driving circuits 31. The demultiplexers 32 supply data signals to data lines D1-Dk of a plurality of pixels P11-P1k of a pixel portion 10. The data driving circuits 31 are connected to the demultiplexers 32 and supply data signals to the demultiplexers 32, respectively.

Each of the data driving circuits 31 receives R, G, and B data from a timing controller (not shown), converts the data into an analog data signal, and supplies the data signal to a data output line DLm.

The data signal is sequentially supplied through the data output line DLm to an input terminal of the demultiplexer 32.

The demultiplexer 32 sequentially supplies the data signal to the pixels P11-P1k in response to a control signal output from the timing controller.

Accordingly, since the data signal is supplied from one demultiplexer 32 to k data lines D1-Dk, the number of the data driving circuits 31 is reduced to 1/k.

In such an OLED device, since a plurality of data lines D1-Dmk are formed on the pixels P11-Pnmk across the pixel portion 10, capacitors are formed. Accordingly, after the capacitor of the data line Dmk is charged with a predetermined electric charge corresponding to a data signal, the data signal is transmitted to a pixel P1mk. The operation of the conventional OLED device having the demultiplexer 32 includes supplying the data signal from the demultiplexer 32 to the data line Dmk and transmitting the supplied data signal to the pixel P1mk enabled by supplying a scan signal for a first horizontal period.

However, because this OLED device should supply the data signal to the k data lines D1-Dk and supply the scan signal to the pixel portion 10 for the first horizontal period, a time required for supplying and transmitting the data signal is not enough. When the data signal is supplied for an insufficient time, the capacitor of the data line Dmk is not fully charged with an electric charge corresponding to the data signal but has the electric charge in common with a storage capacitor of the pixel P1mk. Also, since there is not enough time to transmit the stored data signal to the pixel P1mk, electric charge corresponding to the data signal is not sent to the pixel P1mk. As a result, the OLED device does not emit light with brightness corresponding to the supplied data signal, and thus the image quality is poor.

SUMMARY OF CERTAIN INVENTIVE ASPECTS

The present invention provides an organic light emitting display (OLED) device and a method of operating the same in which a data signal is supplied to a data line for the previous scan period and transmitted to a pixel for the present scan period, with the result that time taken to supply and transmit the data signal is sufficient.

One embodiment is an organic light emitting display (OLED) device including a pixel portion configured to display an image, a scan driver configured to supply a scan signal to the pixel portion, an emission driver configured to supply an emission control signal to the pixel portion, a data driver configured to supply a data signal to the pixel portion, and a demultiplexer configured to receive the data signal from the data driver and to supply the data signal to at least two columns of the pixel portion. The pixel portion is configured to receive the data signal from the demultiplexer and to alternately supply the data signal though at least two data lines to pixels arranged in a single column.

Another embodiment is a method of operating an OLED device having a demultiplexer. The method includes during a previous scan period, supplying a data signal from the demultiplexer either to a first data line connected to pixels arranged in odd rows, or to a second data line connected to pixels arranged in even rows, and during a current scan period, transmitting the supplied data signal from the first or second data line to a pixel.

Another embodiment includes an organic light emitting display (OLED) device including an array of pixels, the array arranged in rows and columns, a plurality of scan lines connected to rows of pixels, a plurality of data lines, each data line being connected to one or more pixels of a column and each data line being not connected to one or more other pixels of the column, and a data driver configured to supply data signals for the data lines.

BRIEF DESCRIPTION OF THE DRAWINGS

The above and other features of the present invention will be described in reference to certain exemplary embodiments thereof with reference to the attached drawings in which.

DETAILED DESCRIPTION OF THE CERTAIN INVENTIVE EMBODIMENTS

Embodiments will now be described more fully hereinafter with reference to the accompanying drawings, in which exemplary embodiments of the invention are shown.

Figure 1:
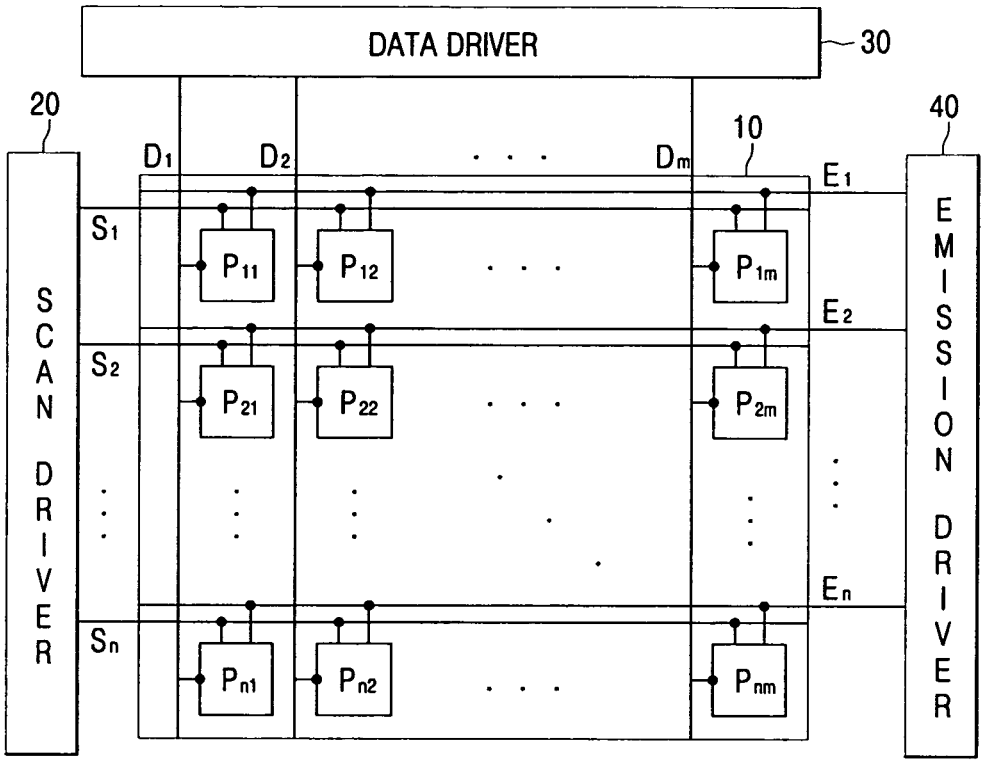
FIG. 1 (PRIOR ART)
FIG. 1 is a schematic diagram of a conventional organic light emitting display (OLED) device.
Figure 2:
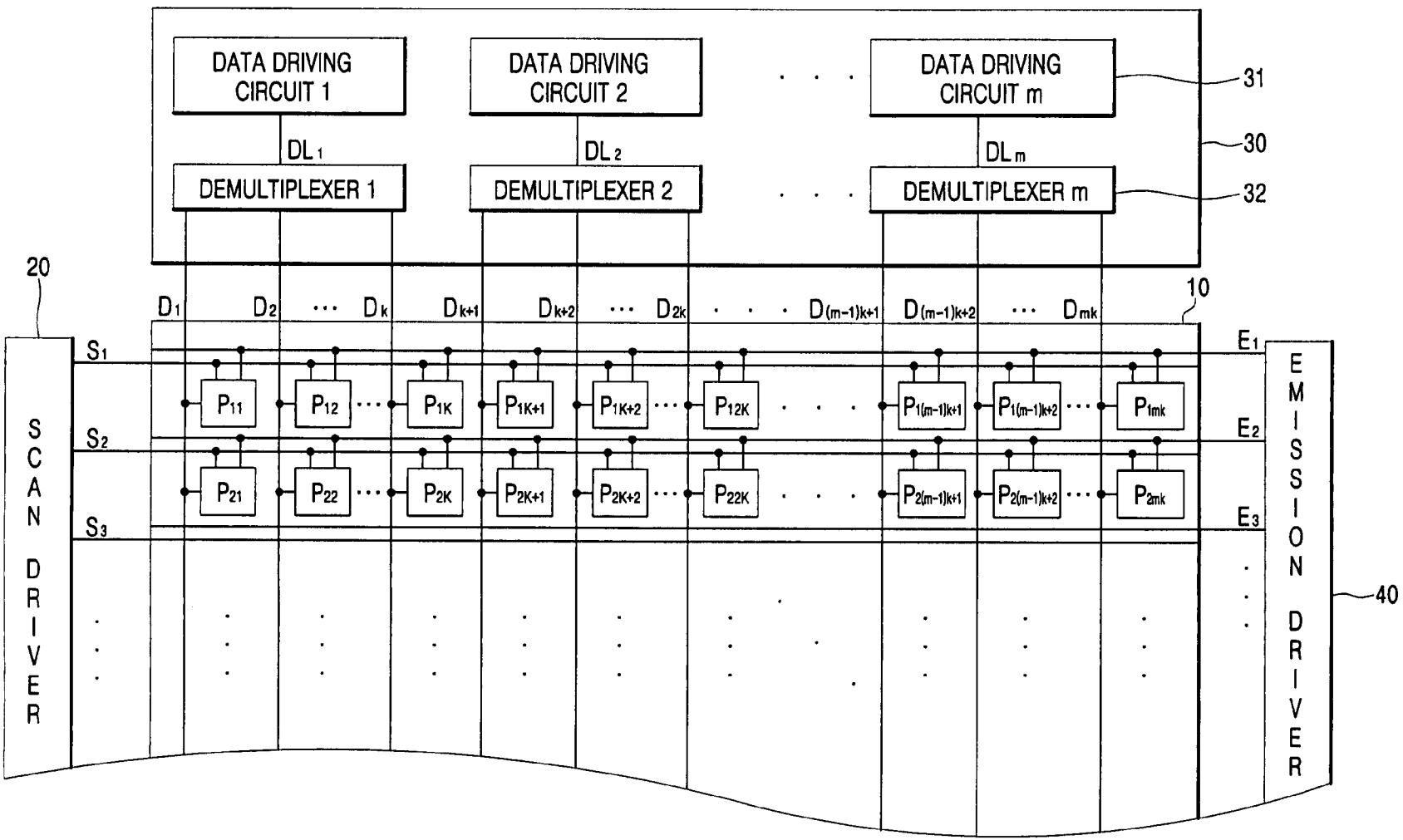
FIG. 2 (PRIOR ART)
FIG. 2 is a schematic diagram of a data driver of the conventional OLED device.
Figure 3:
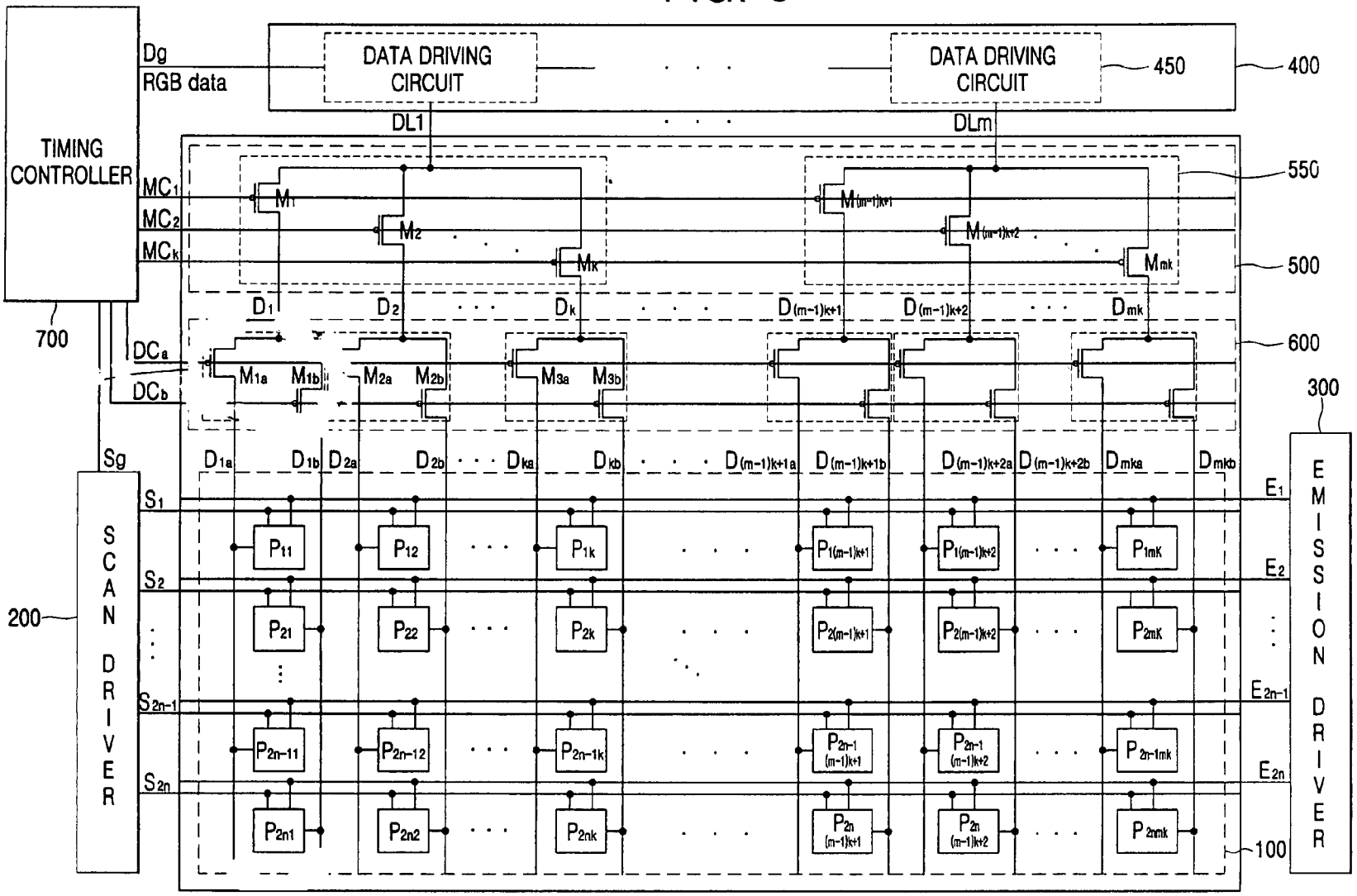
FIG. 3 is a schematic diagram of an OLED device according to an exemplary embodiment of the present invention.

FIG. 3 is a schematic diagram of an organic light emitting display (OLED) device according to an exemplary embodiment of the present invention.

Referring to FIG. 3, the OLED device according to the embodiment of the of FIG. 3 includes a pixel portion 100, a scan driver 200, an emission driver 300, a data driver 400, a demultiplexer unit 500, a data line selector 600, and a timing controller 700.

The scan driver 200 sequentially supplies scan signals to a plurality of scan lines S1-S2n synchronously with scan control signals Sg (i.e., a start pulse and clock signals) supplied from the timing controller 700.

The emission driver 300 may include shift registers, which output emission control signals synchronously with control signals (i.e., the start pulse and clock signals) supplied from the timing controller 700. Also, the OLED device may not additionally include the emission driver 300. That is, even if the OLED device does not include the emission driver 300, emission control signals can be generated by performing a logic operation on output signals or scan signals of shift registers output from the scan driver 200.

The data driver 400 receives red (R), green (G), and blue (B) data and control signals Dg (i.e., the start pulse and clock signals) from the timing controller 700. The data driver 400 includes a plurality of data driving circuits 450, which supply data signals to data output lines DL1-DLm, respectively, and each of the data driving circuits 450 receives the R, G, and B data and the control signals Dg from the timing controller 700.

Each of the data driving circuits 450 includes a shift register, a sampling latch, a holding latch, and a digital/analog (D/A) converter. The shift register transmits sequentially-supplied data to each sampling latch in bit units in response to the control signal DG. The sampling latch receives 1-bit data from the shift register and samples the data. The holding latch holds the sampled data, and the D/A converter converts the stored data into an analog value. Also, the data driving circuit 450 may further include a level shifter, which raises the output signal of the holding latch and supplies the output signal to the D/A converter.

The number of data supplied to each of the data driving circuits 450 corresponds to the number of data lines D1-Dk connected to one demultiplexer 550. Accordingly, when each of the data driving circuits 450 is connected to the demultiplexer 550, which supplies the data signals to the data lines D1, D2, and D3, it receives three data for one horizontal period.

This data driving circuit 450 samples the received R, G, and B data, converts the sampled data into an analog data signal, and supplies the data signal to the data output line DLm.

The demultiplexer unit 500 receives the data signals from the data output lines DL1-DLm and supplies the data signals to the data lines D1-Dmk in response to demultiplexer control signals MC1, MC2, . . . , and MCk. The demultiplexer unit 500 includes a plurality of demultiplexers 550 that are connected to the data output lines DL1-DLm from the respective data driving circuits 450 and receive the data signals therefrom.

Each of the demultiplexers 550 receives the data signal from the data output line DL1-DLm from one data driving circuit 450 and supplies the data signal to the respective data lines D1, D2, . . . , and Dk in response to the control signals MC1, MC2, . . . , and MCk supplied from the timing controller 700.

When each of the demultiplexers 550 receives three data signals for one horizontal period, it includes three transistors M1, M2, and M3, which are connected to three (k=3) data lines D1, D2, and D3, respectively.

The transistor M1 is turned on in response to the control signal MC1 supplied from the timing controller 700 and supplies the data signal from the data output line DL1 to the corresponding data line D1. Also, the transistors M2 and M3 perform similar operations as the transistor M1. The operations of the transistors M1, M2, and M3 are sequentially performed, and detailed descriptions thereof will be described later.

The transistors M1, M2, and M3 are p-type metal oxide semiconductor field effect transistors (MOSFETs). Accordingly, the transistors M1, M2, and M3 of the demultiplexer unit 500 can be produced by the same process as transistors of a pixel circuit formed in the pixel portion 100. The demultiplexer unit 500 is formed on the same substrate as the pixel portion 100, thereby realizing a system on panel (SOP) device. Other embodiments may use various other switching devices, such as n-type transistors.

The pixel portion 100 includes a plurality of pixels P11-P2nmk, which are formed in regions defined by a plurality of scan lines S1-S2n, a plurality of emission control lines E1-E2n, and a plurality of data lines D1-Dmk. Each of the pixels P11-P2nmk includes R, G, and B sub-pixels and receives a data signal from the data driving circuit 300.

The R, G, and B sub-pixels of the pixel P2nmk each have the same pixel circuit construction. The R, G, and B sub-pixels emit R, G, and B light corresponding to current supplied to an organic light emitting diode. Accordingly, the pixel P2nmk combines the light emitted by the R, G, and B sub-pixels and displays a specific color.

In the pixel portion 100, two sub data lines D1*a* and D1*b* are formed across respective pixel columns P11-P2n1. The two sub data lines D1*a* and D1*b* receive one data signal from the demultiplexer 550 and selectively supplies the data signal to the pixel columns P11-P2n1. The first sub data line D1*a* is connected to pixels P11, P31, P51, . . . , and P2n-11 of (2n−1)th rows (odd rows) among pixels arranged in the pixel columns P11-P2n1 and supplies the data signals to the respective pixels P11, P31, P51, . . . , and P2n-11. The second sub data line D1*b* is connected to pixels P21, P41, . . . , and P2n of 2n-th rows (even rows) among the pixels arranged in the pixel columns P11-P2n1 and supplies the data signals to the respective pixels P21, P41, . . . , and P2n.

Since the above-described data lines D1*a*-Dmkb are formed across the pixel portion 100, they have capacitance. The capacitance caused by the data lines D1*a*-Dmkb leads to a loading effect when the data signal is applied from the data driver 400. That is, a delay in transmitting signals occurs due to undesired impedance elements. This capacitance is generated by a parasitic capacitor, which is equivalently induced by conductive layers or metal interconnections opposite insulating layers that are formed on or near the data lines Dmkb and the pixels P1mk-P2nmk. Accordingly, the OLED device having the demultiplexers 550 needs sufficient time to supply the data signal to the parasitic capacitor of the data line Dmkb.

As described above, the OLED device having the double sub data lines D1*a* and D1*b* includes the data line selector 600, which is disposed between the demultiplexer unit 500 and the pixel portion 100 and selectively supplies the data signal to the two sub data lines D1*a* and D1*b*.

The data line selector 600 includes two transistors M1*a* and M1*b*, which are commonly connected to the transistor M1 of the demultiplexer 550 and respectively connected to the two sub data lines D1*a* and D1*b* of the pixel columns P11-P2n1 that receive the data signal from the transistor M1 of the demultiplexer 550.

The first transistor M1 a, which is connected to the first sub data line D1*a*, is turned on in response to a control signal DCa output from the timing controller 700 and transmits the data signal from the transistor M1 of the demultiplexer 550 to the first sub data line D1*a*.

The second transistor M1*b*, which is connected to the second sub data line D1*b*, is turned on in response to a control signal DCb output from the timing controller 700 and transmits the data signal from the transistor M1 of the demultiplexer 550 to the second sub data line D1*b*.

The first and second transistors M1*a* and M1*b* are alternately turned on and off, and the first and second sub data lines D1*a* and D1*b* selectively receive the data signal.

The above-described first and second transistors M1*a* and M1*b* of the data line selector 600 are p-type MOSFETs. Thus, the transistors M1*a* and M1*b* of the data line selector 600 can be produced by the same process as the transistors of the pixel portion 100. The data line selector 600 and the pixel portion 100 are formed on one substrate at the same time, thereby realizing the SOP type. In some embodiments, the first and second transistors M1*a* and M1*b* are other types of switches, such as n-type transistors.

The operation of the OLED device shown in FIG. 3 will now be described with reference to FIG. 4.

Figure 4:
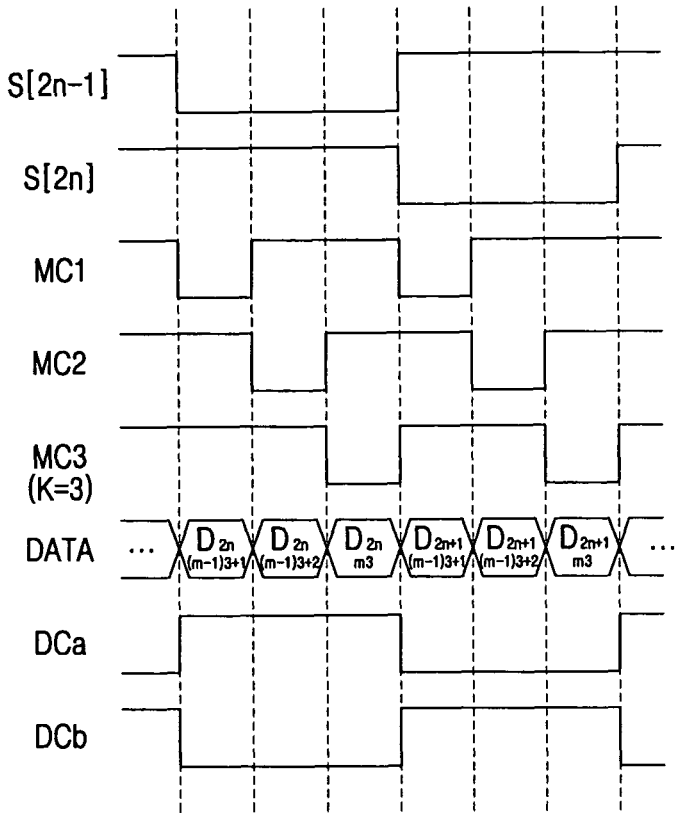
FIG. 4 is a timing diagram illustrating the operation of the OLED device shown in FIG. 3.

FIG. 4 is a timing diagram illustrating the operation of the OLED device shown in FIG. 3.

Hereinafter, the first demultiplexer 550 receiving data signals from the first data driving circuit 450 and the k pixels P11-P1k receiving the data signals from the first demultiplexer 550 will be described. Also, it will be assumed that one demultiplexer 550 supplies the data signal to three pixel columns P11-P1k (k=3) and includes three transistors M1, M2, and M3.

When the scan driver 200 supplies a low-level first scan signal, a first-row first-column pixel (P11) data signal stored in the first sub data line D1*a* of a first column is transmitted to an enabled first-row first-column pixel P11. Also, a first-row second column pixel (P12) data signal stored in a first sub data line D2*a* of a second column is transmitted to an enabled first-row second-column pixel P12, and a first-row third-column pixel (P13) data signal stored in a first sub data line D3*a* of a third column is transmitted to a first-row third-column pixel P13.

During the supply of the low-level first scan signal, three second transistors M1*b*, M2*b*, and M3*b* of the data line selector 600, which are connected to second sub data lines D1*b*-D3*b* of the first through third columns, respectively, receive a low-level control signal DCb from the timing controller 700 and, in response, turn on.

While the second transistors M1*b*, M2*b*, and M3*b* of the data line selector 600 are on, the first data driving circuit 450 transmits a second-row first-column pixel (P21) data signal through the data output line DL1 to the demultiplexer 550. The transistor M1 of the demultiplexer 550, which is connected to the data line D1 of the pixels P11-P2n1 of the first row, is turned on in response to the control signal MC1 output from the timing controller 700 and outputs the second-row first-column pixel (P21) data signal. The second-row first-column pixel (P21) data signal is supplied through the turned-on second transistor M1*b* of the data line selector 600 to the second sub data line D1*b*.

Next, when the first data driving circuit 450 transmits a second-row second-column pixel P22 data signal through the data output line DL1 to the demultiplexer 550, the transistor M2 of the demultiplexer 550, which is connected to the data line D2 of pixels P12-P2n2 of the second row, receives the control signal MC2 from the timing controller 700 and then is turned on. Accordingly, a second sub data line D2*b* of the pixels P12-P2n2 of the second row receives a second-row second-column pixel (P22) data signal through the transistor M2 of the demultiplexer 550 and the second transistor M2*b* of the data line selector 600.

Finally, when the first data driving circuit 450 transmits a second-row third-column pixel (P23) data signal through the data output line DL1 to the demultiplexer 550, the transistor M3 of the demultiplexer 550, which is connected to the data line D3 of pixels P13-P2n3 of the third column, receives the control signal MC3 from the timing controller 700 and turns on. Accordingly, the second sub data line D2*b* of the pixels P13-P2n3 of the third column receives a second-row third-column pixel (P23) data signal through the transistor M3 of the demultiplexer 550 and the second transistor M3*b* of the data line selector 600.

As described above, during the supply of the low-level first scan signal, the second transistors M1*b*, M2*b*, and M3*b* of the data line selector 600 are turned on, and each of the demultiplexers 550 sequentially turns on a transistors M1-Mk. Accordingly, the data signals of the pixels P21-P2k of the second row are supplied to the second sub data lines D1*b*-Dkb through the turned-on second transistors M1*b*, M2*b*, and M3*b*, respectively.

As explained above, the operation of sequentially supplying data signals of k pixels P11-P1k is performed by an m number of data driving circuits 450 at the same time. Also, the operation of outputting the data signals by sequentially turning on k transistors M1-Mk is performed by an m number of demultiplexers 550 at the same time. Accordingly, transistors M1, Mk+1, . . . , M (m−1) k+1, which operate symmetrically in the m number of demultiplexers 550, receive the same control signal MC1 from the timing controller 700 and turn on at the same time. The operation of turning on the second transistor M1*b* of the data line selector 600 during the supply of the first scan signal is performed in an m×k number of second transistors M1*b*, M2*b*, M3*b*, . . . at the same time. Accordingly, the m×k second transistors M1*b*, M2*b*, M3*b*, . . . , which operate symmetrically, receive the same control signal DCb from the timing controller 700 and turn on at the same time. The control signal DCb is active for the same amount of time as the scan signal and remains at a low level while the low-level first scan signal is being supplied. Therefore, the control signal DCb can be obtained by performing a logic operation on output signals of the scan driver 200.

Once the scan driver 200 supplies a low-level second scan signal to the pixel portion 100, the pixels P21-P2k of the second row are enabled. Thus, the second-row first-column (P21) data signal, which is stored in the second sub data line D1*b* of a first column, is transmitted to the enabled second-row first-column pixel P21. Also, the second-row second-column (P22) data signal, which is stored in the second sub data line D2*b* of a second column, is transmitted to the enabled second-row second-column pixel P22, and the second-row third-column (P23) data signal, which is stored in the second sub data line D3*b* of a third column, is transmitted to the enabled second-row third-column pixel P23.

Accordingly, a sufficient electric charge is shared between a parasitic capacitor of each sub data line and a storage capacitor of each pixel for a scan period having an active duration of one horizontal period, so that the storage capacitor of the pixel is charged with an electric charge corresponding to the data signal.

During the supply of the low-level second scan signal, the first transistors M1*a*, M2*a*, and M3*a* of the three data line selector 600, which are connected to the first sub data lines D1*a*-D3*a* of the first through third columns, respectively, receive a low-level control signal DCa from the timing controller 700 and then turn on at the same time.

While the first transistors M1*a*, M2*a*, and M3*a* of the data line selector 600 are turned on, the first data driving circuit 450 sequentially generates a third-row first-column pixel (P31) data signal, a third-row second-column pixel (P32) data signal, and a third-row third-column pixel (P33) data signal. The three data signals are transmitted to the data line selector 600 through the three transistors M1, M2, and M3, which are sequentially turned on in response to the control signals MC1, MC2, and MC3 of the timing controller 700. Also, the three data signals are supplied to the three first sub data lines D1*a*, D2*a*, and D3*a*, respectively, through the turned-on first transistors M1*a*, M2*a*, and M3*a* of the data line selector 600.

As described above, during the supply of the low-level second scan signal, the k first transistors M1*a*, M2*a*, M3*a*, . . . of the data line selector 600 are turned on, and each of the demultiplexers 550 sequentially turns on the transistors M1-Mk. Thus, data signals of pixels P31-P3k of the third row are supplied to the first sub data lines D1*a*, D2*a*, and D3*a*, respectively, through the turned-on transistors M1*a*, M2*a*, M3*a*, . . .

As explained above, the operation of sequentially supplying the data signals of the k pixels P11-P1k is performed by the m data driving circuits 450. Also, the operation of outputting the data signals by sequentially turning on the k transistors M1-Mk is performed by the m demultiplexers 550. Accordingly, the transistors M1, Mk+1, . . . , M (m−1) k+1, which operate symmetrically in the m demultiplexers 550, receive the same control signal MC1 from the timing controller 700 and turn on at the same time. The operation of turning on the first transistor M1*a* of the data line selector 600 during the supply of the first scan signal is performed in the m×k first transistors M1*a*, M2*a*, M3*a*, . . . at the same time. Accordingly, the m×k first transistors M1*a*, M2*a*, M3*a*, . . . , which operate symmetrically, receive the same control signal DCa from the timing controller 700 and turn on at the same time. The control signal DCa has the same amount of active time as the scan signal and remains at a low level during the supply of the low-level second scan signal. Therefore, the control signal DCa can be obtained by performing a logic operation on output signals of the scan driver 200.

The above-described operations are repeatedly continued until a 2n-th scan signal is supplied and an electric charge is shared by pixels P2n1-P2nmk arranged in a 2n-th row.

Therefore, when a low-level (2n−1)th (n is an odd number) scan signal is supplied, the second transistor M1*b* of the data line selector 600 turns on and supplies a 2n-row pixel (P2n1) data signal to the second sub data line D1*b*. Also, when a low-level 2n-th (n is an even number) scan signal is supplied, the first transistor M1*a* of the data line selector 600 turns on and supplies a (2n+1)-row pixel (P2n+11) data signal to the first sub data line D1*a*.

In the above-described operations, a data signal is supplied to a data line for the previous scan period and an electric charge is shared between an enabled pixel and the data line for the present scan period. Thus, sufficient time to supply the data signal and share the electric charge can be ensured.

Figure 5:
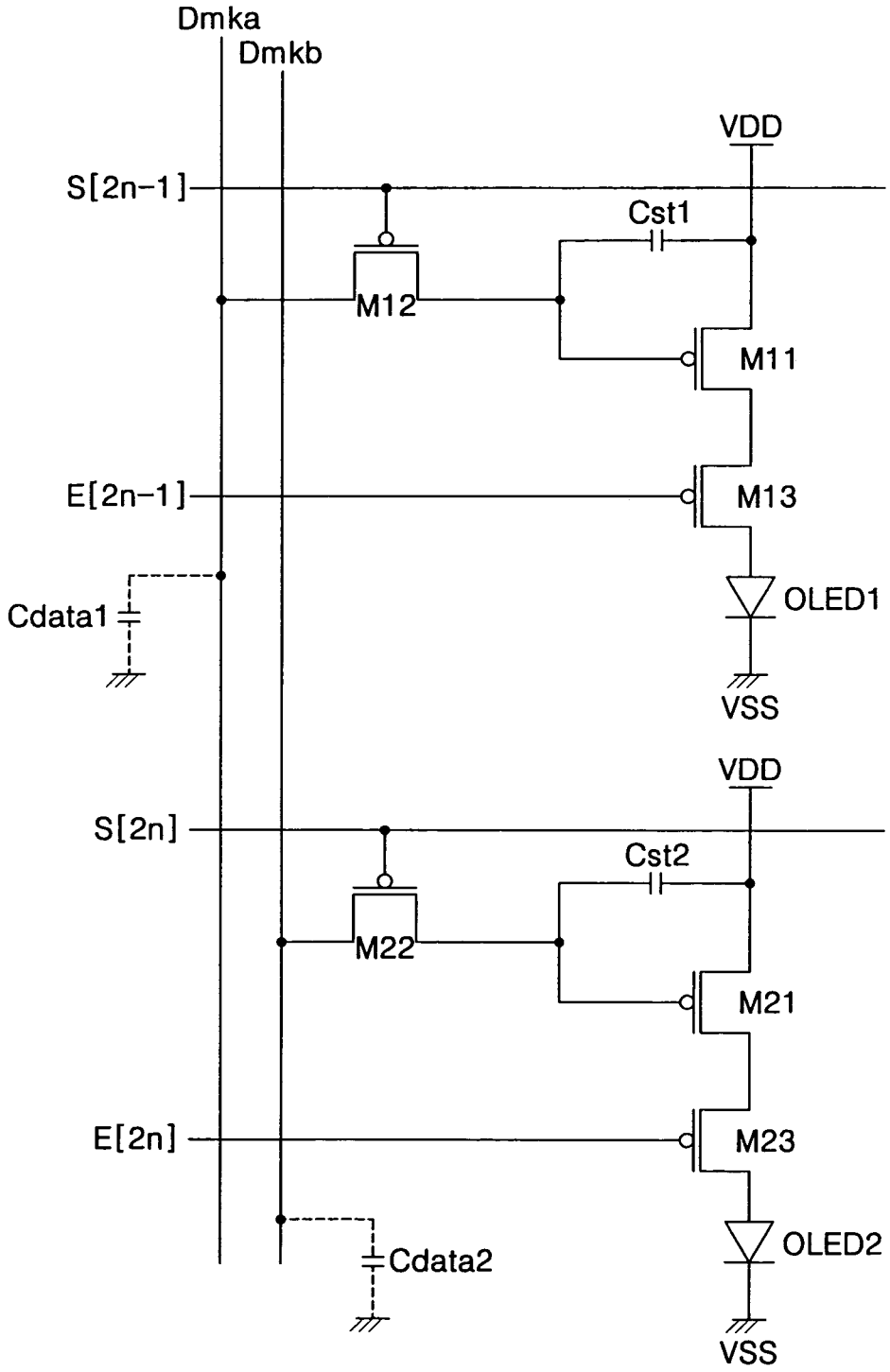
FIG. 5 is a circuit diagram of a pixel of the OLED device shown in FIG. 4.

FIG. 5 is a circuit diagram of two pixels of the OLED device shown in FIG. 3.

For brevity of explanation, only a pixel P2nmk that receives a 2n-th scan signal and a 2n-th emission control signal and also receives a data signal from an mk-th data line will be described with reference to FIG. 5.

Referring to FIG. 5, the pixel P2nmk of the OLED device includes transistors M21, M22, and M23, a storage capacitor Cst2, and an organic light emitting diode OLED2.

The driving transistor M21 is a transistor for controlling a driving current supplied to the organic light emitting diode OLED2. The driving transistor M21 has a source electrode connected to a power supply voltage VDD, and a drain electrode connected to a source electrode of the emission control transistor M23.

The emission control transistor M23 is a transistor for enabling or blocking the flow of current into the organic light emitting diode OLED2. The emission control transistor M23 has the source electrode connected to the drain electrode of the driving transistor M21, and a drain electrode connected to an anode electrode of the organic light emitting diode OLED2.

The organic light emitting diode OLED2 has a cathode electrode connected to a power supply voltage VSS, and the anode electrode connected to the drain electrode of the emission control transistor M23. The organic light emitting diode OLED2 emits light corresponding to the amount of driving current supplied from the driving transistor M21.

The switching transistor M22 transmits a data signal Vdata applied to the second sub data line Dmkb to one electrode of the storage capacitor Cst2 in response to a scan signal applied from the scan line S2n.

The storage capacitor Cst2 has one electrode connected to a gate electrode of the driving transistor M21, and the other electrode connected to the power supply voltage VDD.

Hereinafter, the operations of the pixel circuit shown in FIG. 5 will be described with reference to FIG. 6.

Figure 6:
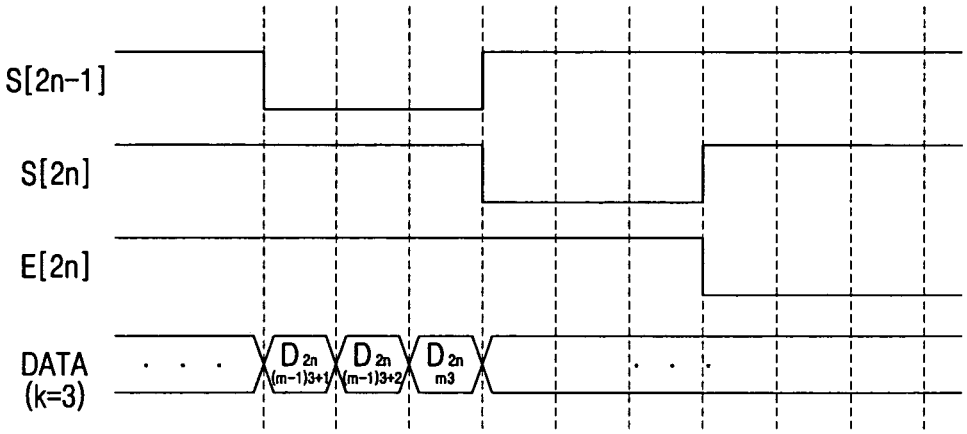
FIG. 6 is a timing diagram illustrating the operation of the pixel circuit of the OLED device shown in FIG. 4.

FIG. 6 is a timing diagram illustrating the operation of the pixel circuit of the OLED device shown in FIG. 4.

Once the scan driver 200 supplies a low-level (2n−1)th scan signal, the second transistor Mmkb of the data line selector 600 turns on and supplies a 2n-row mk-column pixel (P2nmk ) data signal to the second sub data line Dmkb. The second sub data line Dmkb has a capacitor Cdata2, which is formed between the second sub data line Dmkb and nearby metal interconnections Accordingly, the capacitor Cdata2 in the second sub data line Dmkb is charged with an electric charge corresponding to the 2n-row mk-column pixel (P2nmk ) data signal. However, since the switching transistor M22 of the pixel P2nmk is turned off, no electric charge is shared between the storage capacitor Cst2 of the pixel P2nmk and the capacitor Cdata2 in the second sub data line Dmkb.

Next, once the scan driver 200 supplies a low-level 2n-th scan signal, the pixel P2nmk is enabled. Thus, the switching transistor M22 is turned on, so that the storage capacitor Cst2 of the pixel P2nmk and the capacitor Cdata2 in the second sub data line Dmkb are connected to each other by the switching transistor M22 and have an electric charge in common. Thus, the storage capacitor Cst2 is charged with an electric charge corresponding to a difference between the power supply voltage VDD and the data voltage Vdata. Subsequently, once a low-level emission control signal is applied to the emission control transistor M23, the emission control transistor M23 is turned on, and thus the driving transistor M21 is connected to the organic light emitting diode OLED2. Accordingly, current corresponding to the electric charge stored in the storage capacitor Cst2 flows from the drain electrode of the driving transistor M21 to the anode electrode of the organic light emitting diode OLED2, so that the organic light emitting diode OLED2 emits light.

As described above, a data signal is supplied and an electric charge is shared between the capacitor Cdata2 of the data line and the storage capacitor Cst2 of the pixel P2nmk for a sufficient time that the organic light emitting display device can emit light with a luminance corresponding to the data signal. Although it is described that the pixel circuit includes only the three transistors M21, M22, and M23 and one capacitor Cst2, the present invention is not limited thereto, but other embodiments of the pixel circuit can be used.

As described above, the OLED device having demultiplexers includes two data lines in each pixel column. Thus, a data signal is supplied for the previous scan period and transmitted to a corresponding pixel for the present scan period. As a result, time taken to supply and transmit the data signal is sufficient, so that the OLED device can emit light with a luminance corresponding to the supplied data signal.

Although certain embodiments have been described, it will be understood by those skilled in the art that a variety of modifications and variations may be made without departing from the spirit or scope of the present invention.

What is claimed is:

1. An organic light emitting display (OLED) device comprising:

a pixel portion configured to display an image;

a plurality of pixels arranged with a matrix type;

a scan driver configured to supply a plurality of scan signals to a plurality of scan lines connected to a plurality of pixel rows respectively;

an emission driver configured to supply an emission control signal to the pixel portion;

a data driver configured to output a plurality of data signals;

a plurality of demultiplexers configured to receive the plurality of data signals and to selectively output the plurality of data signals; and a plurality data line selector configured to receive the plurality of data signals respectively and output the plurality of data signals to a plurality of first data lines and a plurality of second data lines alternately, wherein the plurality of the first data lines and the plurality of second data lines are connected to a plurality of pixels columns respectively, and wherein the plurality data line selector outputs the plurality of data signals to one of the plurality of the first data lines and the plurality of the second data lines during a time when the scan driver supplies a scan signal with an on level voltage to a corresponding scan line, and the others of the plurality of the first data lines and the plurality of the second data lines are connected to pixels connected to the scan line during that time.

2. The OLED device according to claim 1, wherein one of the demultiplexer includes at least two transistors, which are configured to be sequentially turned on and to supply the data signal to at least two columns of the plurality of pixels arranged with a matrix type.

3. The OLED device according to claim 2, wherein the plurality of pixels arranged with a matrix type includes:

a plurality of pixels arranged in rows and columns;

a plurality of scan lines configured to transmit the scan signal to pixels arranged in the rows;

a plurality of emission control lines configured to transmit the emission control signal to pixels arranged in the rows;

a plurality of first data lines disposed on one side of pixels arranged in the columns; and a plurality of second data lines disposed on the other side of the pixels arranged in the columns.

4. The OLED device according to claim 3, wherein the first data lines are configured to transmit the data signal to pixels arranged in odd rows, and the second data lines are configured to transmit the data signals to the pixels arranged in even rows.

5. The OLED device according to claim 4, further comprising first and second transistors disposed between one of the demultiplexers and the first and second data lines, the first and second transistors configured to receive the data signal from the one of the demultiplexers and alternately supply the data signal to the first and second data lines.

6. The OLED device according to claim 5, wherein the first transistors are connected to the first data lines and are configured to be turned on when the scan driver supplies the scan signal to the pixels arranged in the even rows, and to supply the data signal to the first data lines, and the second transistors are connected to the second data lines and are configured to be turned on when the scan driver supplies the scan signal to the pixels arranged in the odd rows, and to supply the data signal to the second data lines.

7. The OLED device according to claim 6, wherein the transistors of the one of the demultiplexers and the first and second transistors connected to the first and second data lines are PMOS transistors.

8. The OLED device according to claim 7, wherein the one of the demultiplexers, the first and second transistors connected to the first and second data lines, and the plurality of pixels arranged with a matrix type are formed on the same substrate.

9. The OLED device according to claim 1, wherein one of the plurality of demultiplexers is configured to receive the data signal and to selectively supply the data signal to at least three columns of the plurality of pixels arranged with a matrix type.

10. The OLED device according to claim 1, additionally comprising a timing controller configured to output a plurality of control signals to control the selection of the data signal to each of at least two columns of the plurality of pixels arranged with a matrix type and to output a plurality of control signals to control the selection of the connection of the data signal to either of the first data line or the second data line.

11. A method of operating an OLED device having a demultiplexer, the method comprising:

during a previous scan period, connecting a node having a data signal to at least first and second columns, wherein for each column, the node is connected either to a first data line connected to a plurality of pixels in odd rows or to a second data line connected to a plurality of pixels in even rows; and during a current scan period, transmitting the supplied data signal from the first or second data line to a pixel.

12. The method according to claim 11, further comprising alternately connecting the node to the first and second data lines.

13. The method according to claim 12, wherein connecting the node comprises selectively turning on one or more of a plurality of transistors of the demultiplexer.

14. The method according to claim 13, wherein transmitting the supplied data signal from the first or second data line to the pixel comprises turning on a transistor of the pixel so as to transmit the data signal to the pixel.

15. The method according to claim 14, wherein the transistors of the demultiplexer are PMOS transistors.

16. The method according to claim 11, wherein connecting a node comprises connecting a node having a data signal to at least three columns.

17. An organic light emitting display (OLED) device, comprising:

an array of pixels, the array arranged in rows and columns;

a plurality of scan lines connected to rows of pixels;

a data driver configured to supply a plurality of data signals;

a plurality of demultiplexers comprising a plurality of switches configured to receive the plurality of data signals and to selectively output the plurality of data signals;

a plurality data line selector configured to receive the plurality of data signals respectively and output the plurality of data signals to a plurality of first data lines and a plurality of second data lines alternately, wherein the plurality of the first data lines and the plurality of second data lines are connected to a plurality of pixel columns respectively, and wherein the plurality data line selector outputs the plurality of data signals to one of the plurality of the first data lines and the plurality of the second data lines during a time when the scan driver supplies a scan signal with an on level voltage to a corresponding scan line, and the others of the plurality of the first data lines and the plurality of the second data lines are connected to pixels connected to the scan line during that time.

18. The OLED device according to claim 17, further comprising a scan driver configured to sequentially supply a scan signal to each of the rows, wherein the data driver is configured to supply the data signal to a data line connected to a pixel of a next row during a time when the scan driver supplies a scan signal to a current row.

19. The OLED device according to claim 18, wherein the data line connected to the pixel of the next row is configured to store the data signal during the time when the scan driver supplies the scan signal to the current row, and to provide the data signal to the pixel of the next row during a time when the scan driver supplies a scan signal to the next row.

20. The OLED device according to claim 19, wherein the pixel of the next row is configured to store the data signal, and to provide a current to a light emitting diode, the current being generated based on the data signal.

21. The OLED device according to claim 17, wherein a first plurality of pixels are in even rows and a second plurality of pixels are in odd rows.

22. The OLED device according to claim 17, wherein the plurality of demultiplexers and the array are formed on the same substrate.

* * * * *